US007834824B2

(12) United States Patent
Routley et al.

(10) Patent No.: US 7,834,824 B2
(45) Date of Patent: Nov. 16, 2010

(54) DISPLAY DRIVER CIRCUITS

(75) Inventors: Paul R. Routley, Longstanton (GB); Euan C. Smith, Longstanton (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 69 days.

(21) Appl. No.: 10/518,182

(22) PCT Filed: Jun. 11, 2003

(86) PCT No.: PCT/GB03/02529

§ 371 (c)(1),
(2), (4) Date: Jun. 20, 2005

(87) PCT Pub. No.: WO03/107313

PCT Pub. Date: Dec. 24, 2003

(65) Prior Publication Data

US 2006/0038758 A1 Feb. 23, 2006

(30) Foreign Application Priority Data

Jun. 18, 2002 (GB) ..... 0213986.3

(51) Int. Cl.
*G09G 3/30* (2006.01)

(52) U.S. Cl. ..... 345/77; 345/76; 345/83

(58) Field of Classification Search ..... 345/30, 345/36, 39, 44–46, 55, 76–83, 204–207, 345/211–212, 214–215, 690, 697; 315/169.3
See application file for complete search history.

(56) References Cited

U.S. PATENT DOCUMENTS 4,539,507 A 9/1985 VanSlyke et al. ..... 313/504

(Continued)

FOREIGN PATENT DOCUMENTS

EP 717 446 A2 6/1996

(Continued)

OTHER PUBLICATIONS

Derwent Abstract of JP-2000-132133.*

(Continued)

*Primary Examiner*—Alexander Eisen
*Assistant Examiner*—Jason M Mandville
(74) *Attorney, Agent, or Firm*—Marshall, Gerstein & Borun LLP

(57) ABSTRACT

This disclosure generally relates to display driver circuits for electro-optic displays, and more particularly relates to circuits and methods for driving active matrix organic light emitting diode displays with greater efficiency. A display driver for an electroluminescent display, the display including a plurality of electroluminescent display elements each associated with a display element driver circuit, each display element driver circuit including a drive transistor having a control connection for driving the associated display element in accordance with a voltage on the control connection, the display driver including at least one display element brightness controller to provide an output to drive a control connection to control the electroluminescent output from a display element; a voltage sensor to sense the voltage on a control connection; and a power controller for controlling an adjustable power supply for providing an adjustable voltage to the electroluminescent display to power said drive transistors for driving said display elements, the power controller being configured to provide a control signal to adjust said power supply voltage in response to said sensed voltage.

10 Claims, 10 Drawing Sheets

U.S. PATENT DOCUMENTS

Figure 1A:
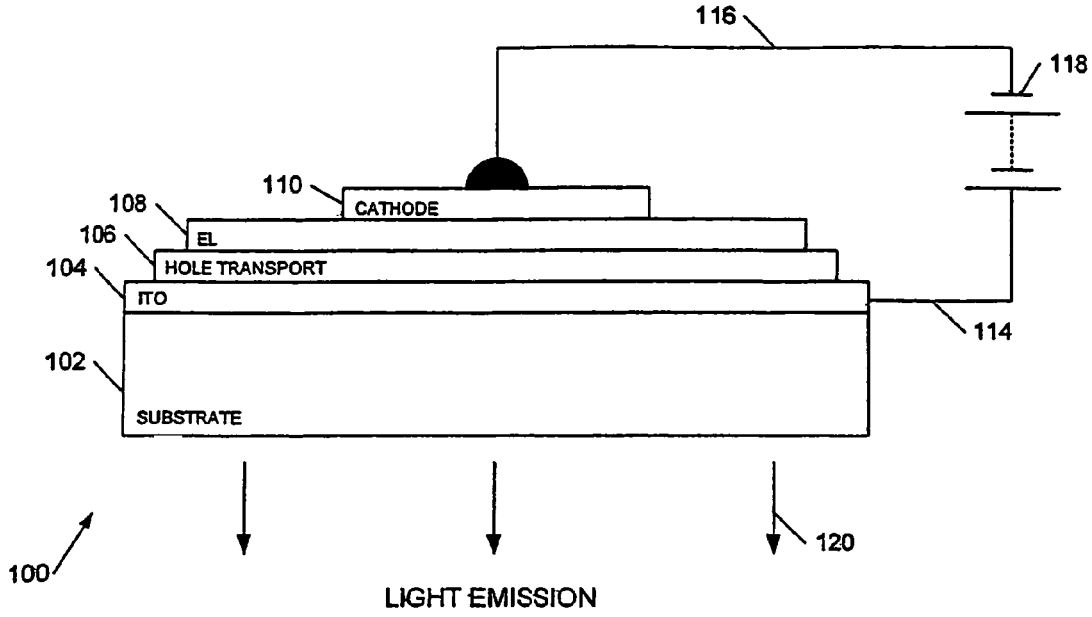
Figure 1a (PRIOR ART)

| | | | | |
|---|---|---|---|---|
| 4,823,121 | A | 4/1989 | Sakamoto et al. | |
| 5,075,596 | A | 12/1991 | Young et al. | |
| 5,594,463 | A | 1/1997 | Sakamoto | 345/76 |
| 5,748,160 | A | 5/1998 | Shieh et al. | |
| 5,903,246 | A | 5/1999 | Dingwall | 345/82 |
| 5,949,194 | A * | 9/1999 | Kawakami et al. | 315/169.4 |
| 6,014,119 | A | 1/2000 | Staring et al. | |
| 6,201,520 | B1 | 3/2001 | Iketsu et al. | |
| 6,323,849 | B1 | 11/2001 | He et al. | |
| 6,332,661 | B1 | 12/2001 | Yamaguchi et al. | |
| 6,414,661 | B1 * | 7/2002 | Shen et al. | 345/82 |
| 6,424,326 | B2 * | 7/2002 | Yamazaki et al. | 345/77 |
| 6,518,962 | B2 * | 2/2003 | Kimura et al. | 345/211 |
| 6,730,966 | B2 | 5/2004 | Koyama et al. | |
| 6,738,031 | B2 * | 5/2004 | Young et al. | 345/55 |
| 6,847,171 | B2 * | 1/2005 | Tam | 315/169.3 |
| 7,030,841 | B2 * | 4/2006 | Abe et al. | 345/76 |
| 7,239,309 | B2 * | 7/2007 | Smith et al. | 345/207 |
| 7,583,261 | B2 * | 9/2009 | Shirasaki et al. | 345/212 |
| 2001/0019327 | A1 * | 9/2001 | Kim et al. | 345/204 |
| 2001/0024186 | A1 | 9/2001 | Kane et al. | 345/98 |
| 2002/0101395 | A1 * | 8/2002 | Inukai | 345/83 |
| 2002/0126073 | A1 * | 9/2002 | Knapp et al. | 345/76 |
| 2002/0167471 | A1 | 11/2002 | Everitt | |
| 2002/0175634 | A1 | 11/2002 | Ishizuka et al. | |
| 2003/0011314 | A1 | 1/2003 | Numao | |
| 2005/0007320 | A1 * | 1/2005 | Smith et al. | 345/77 |
| 2005/0007353 | A1 * | 1/2005 | Smith et al. | 345/204 |
| 2005/0140610 | A1 * | 6/2005 | Smith et al. | 345/77 |
| 2006/0001613 | A1 * | 1/2006 | Routley et al. | 345/76 |

FOREIGN PATENT DOCUMENTS

| | | | |
|---|---|---|---|
| EP | 717 446 | A3 | 6/1996 |
| EP | 0 811 866 | A1 | 12/1997 |
| EP | 923 067 | A1 | 6/1999 |
| EP | 1 079 361 | A1 | 2/2001 |
| EP | 1 091 339 | A2 | 4/2001 |
| EP | 1 096 466 | A1 | 5/2001 |
| EP | 1 091 339 | A3 | 4/2002 |
| EP | 1 291 838 | A1 | 3/2003 |
| GB | 2 360 870 | | 10/2001 |
| GB | 2 381 643 | | 5/2003 |
| GB | 2 381 644 | | 5/2003 |
| GB | 2 386 462 | | 9/2003 |
| JP | 5-35207 | | 2/1993 |
| JP | 2000-132133 | | 5/2000 |
| JP | 2001-32133 | | 5/2000 |
| JP | 2002-169511 | | 6/2002 |
| WO | WO 90/13148 | | 11/1990 |
| WO | WO 95/06400 | | 3/1995 |
| WO | WO 99/42983 | | 8/1999 |
| WO | WO 99/48160 | | 9/1999 |
| WO | WO 99/54936 | | 10/1999 |
| WO | WO 01/20591 | | 3/2001 |
| WO | WO 01/27910 | | 4/2001 |
| WO | WO-03/091983 | | 11/2003 |

OTHER PUBLICATIONS

International Search Report in PCT/GB03/02529 dated Dec. 19, 2003.

* cited by examiner

150

DISPLAY DRIVER CIRCUITS

This is the U.S. national phase of International Application No. PCT/GB03/02529 filed Jun. 11, 2003, the entire disclosure of which is incorporated herein by reference.

This invention generally relates to display driver circuits for electro-optic displays, and more particularly relates to circuits and methods for driving active matrix organic light emitting diode displays with greater efficiency.

Organic light emitting diodes (OLEDs) comprise a particularly advantageous form of electro-optic display. They are bright, colorful fast-switching, provide a wide viewing angle and are easy and cheap to fabricate on a variety of substrates. Organic LEDs may be fabricated using either polymers or small molecules in a range of colours (or in multi-coloured displays), depending upon the materials used. Examples of polymer-based organic LEDs are described in WO 90/13148, WO 95/06400 and WO 99/48160; examples of so called small molecule based devices are described in U.S. Pat. No. 4,539,507.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise, for example, PEDOT:PSS (polystyrene-sulphonate-doped polyethylene-dioxythiophene). Cathode layer 110 typically comprises a low work function metal such as calcium and may include an additional layer immediately adjacent electroluminescent layer 108, such as a layer of aluminium, for improved electron energy level matching. Contact wires 114 and 116 to the anode the cathode respectively provide a connection to a power source 118. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example by keeping the thickness of cathode layer 110 less than around 50-100 nm so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. It will be appreciated that with such an arrangement it is desirable to have a memory element associated with each pixel so that the data written to a pixel is retained whilst other pixels are addressed. Generally this is achieved by a storage capacitor which stores a voltage set on a gate of a driver transistor. Such devices are referred to as active matrix displays and examples of polymer and small-molecule active matrix display drivers can be found in WO 99/42983 and EP 0,717,446A respectively.

Figure 1B:
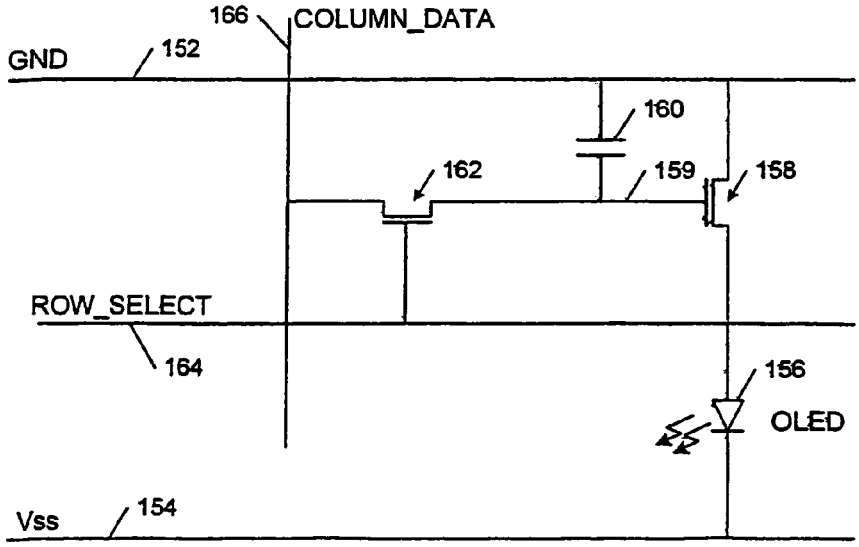
Figure 1b (PRIOR ART)

FIG. 1*b* shows such a typical OLED driver circuit 150. A circuit 150 is provided for each pixel of the display and ground 152, $V_{ss}$ 154, row select 164 and column data 166 busbars are provided interconnecting the pixels. Thus each pixel has a power and ground connection and each row of pixels has a common row select line 164 and each column of pixels has a common data line 166.

Each pixel has an organic LED 156 connected in series with a driver transistor 158 between ground and power lines 152 and 154. A gate connection 159 of driver transistor 158 is coupled to a storage capacitor 160 and a control transistor 162 couples gate 159 to column data line 166 under control of row select line 164. Transistor 162 is a field effect transistor (FET) switch which connects column data line 166 to gate 159 and capacitor 160 when row select line 164 is activate& Thus when switch 162 is on a voltage on column data line 166 can be stored on a capacitor 160. This voltage is retained on the capacitor for at least the frame refresh period because of the relatively high impedances of the gate connection to driver transistor 158 and of switch transistor 162 in its "off" state.

Driver transistor 158 is typically an FET transistor and passes a (drain source) current which is dependent upon the transistor's gate voltage less a threshold voltage. Thus the voltage at gate node 159 controls the current through OLED 156 and hence the brightness of the OLED.

The standard voltage-controlled circuit of FIG. 1*b* suffers from a number of drawbacks. The main problems arise because the brightness of OLED 156 is dependent upon the characteristics of the OLED and of the transistor 158 which is driving it In general, these vary across the area of a display and with time, temperature, and age. This makes it difficult to predict in practice how bright a pixel will appear when driven by a given voltage on column data line 166. In a colour display the accuracy of colour representations may also be affected.

Figure 2A:
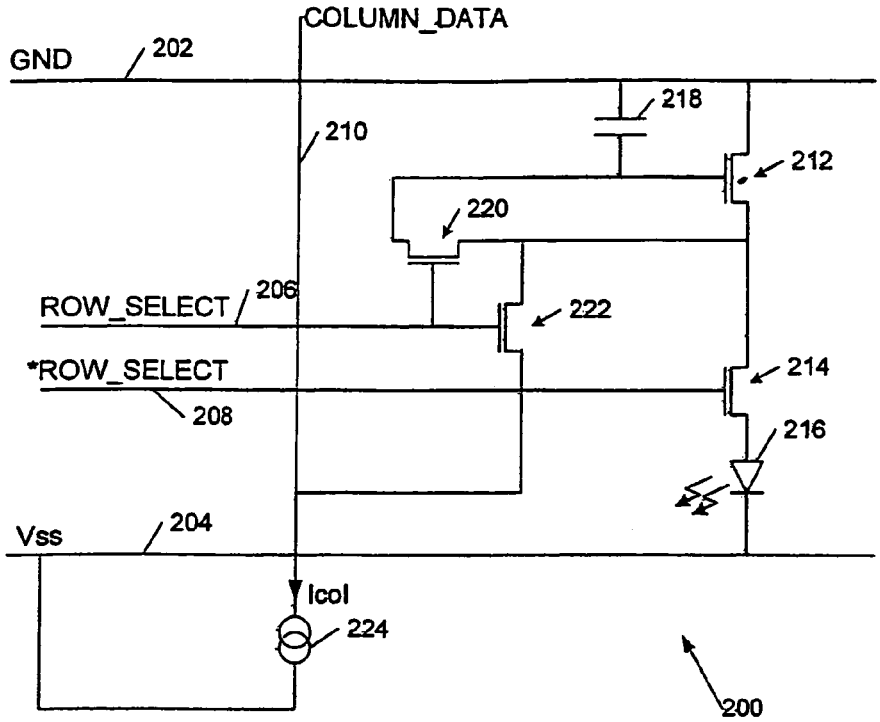

FIG. 2*a* shows a current-controlled pixel driver circuit 200 which addresses these problems. In this circuit the current through an OLED 216 is set by setting a drain source current for OLED driver transistor 212 using a reference current sink 224 and memorising the driver transistor gate voltage required for this drain-source current. Thus the brightness of OLED 216 is determined by the current, $I_{col}$, flowing into reference current sink 224, which is preferably adjustable and set as desired for the pixel being addressed. It will be appreciated that one current sink 224 is provided for each column data line 210 rather than for each pixel.

In more detail, power 202, 204, column data 210, and row select 206 lines are provided as described with reference to the voltage-controlled pixel driver of FIG. 1*b*. In addition an inverted row select line 208 is also provided, the inverted row select line being high when row select line 206 is low and vice versa A driver transistor 212 has a storage capacitor 218 coupled to its gate connection to store agate voltage for driving the transistor to pass a desired drain-source current Drive transistor 212 and OLED 216 are connected in series between a power 202 and ground 204 lines and, in addition, a further switching transistor 214 is connected between drive transistor 212 and OLED 216, transistor 214 having a gate connection coupled to inverted row select line 208. Two further switching transistors 220, 222 are controlled by non-inverted row select line 206.

In the embodiment of the current-controlled pixel driver circuit 200 illustrated in FIG. 2*a* all the transistors are PMOS, which is preferable because of their greater stability and better resistance to hot electron effects. However NMOS transistors could also be used In the circuit of FIG. 2*a* the source connections of the transistors are towards GND and for present generation OLED devices $V_{ss}$ is typically around −6 volts. When the row is active the row select line 206 is thus driven at a more negative voltage, up to approximately −20 volts and inverted row select line 208 is driven at 0 volts.

When row select is active transistors 220 and 222 are turned on and transistor 214 is turned off. Once the circuit has reached a steady state reference current $I_{col}$ into current sink 224 flows through transistor 222 and transistor 212 (the gate of 212 presenting a high impedance). Thus the drain-source current of transistor 212 is substantially equal to the reference current set by current sink 224 and the gate voltage required for this drain-source current is stored on capacitor 218. Then, when row select becomes inactive, transistors 220 and 222 are turned off and transistor 214 is turned on so that this same current now flows through transistor 212, transistor 214, and OLED 216. Thus the current through OLED is controlled to be substantially the same as that-set by reference current sink 224.

Before this steady state is reached the voltage on capacitor 218 will generally be different from the required voltage and thus transistor 212 will not pass a drain source current equal to the current, $I_{col}$, set by reference sink 224. When such a mismatch exists a current equal to the difference between the reference current and the drain-source current of transistor 212 flows onto or off capacitor 218 through transistor 220 to thereby change the gate voltage of transistor 212. The gate voltage changes until the drain-source current of transistor 212 equals the reference current set by sink 224, when the mismatch is eliminated and no current flows through transistor 220.

In the circuit of FIG. 2*a* the maximum (most negative) gate voltage drive is $V_{ss}$. To permit a greater (more negative) drive voltage reference sink 224 may be connected to a drive voltage $V_{drive}$ more negative than $V_{ss}$.

The circuit of FIG. 2*a* solves some of the problems associated with the voltage-controlled circuit of FIG. 1*b* as the current through OLED 216 can be set irrespective of variations in the characteristics of pixel driver transistor 212. However it is still prone to variations in the characteristics of OLED 216 between pixels, between active matrix display devices, and with temperature and time.

Figure 2B:
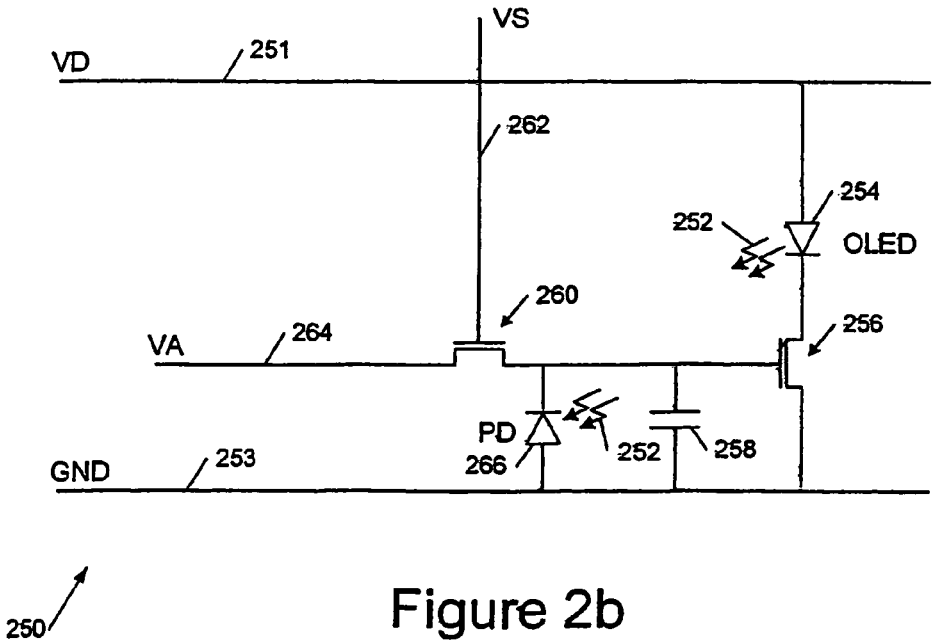
Figure 2b (PRIOR ART)

For this reason optical feedback may be-employed to control the OLED current, as described in WO 01/20591, EP 0,923,067A, EP 1,096,466A, and JP 5-035,207, which all employ the same basic technique. FIG. 2*b,* which is taken from WO 01/20591, illustrates the technique, which is to connect a photodiode across the storage capacitor.

FIG. 2*b* shows a voltage-controlled pixel driver circuit 250 with optical feedback 252. The main components of the driver circuit 250 of FIG. 2*b* correspond to those of circuit 150 of FIG. 1*b,* that is, an OLED 254 in series with a driver transistor 256 having a storage capacitor 258 coupled to its gate connection. As illustrated, the pixel driver circuit has connections 251 and 253 to, respectively, a positive-supply $V_D$ and to Ground and driver transistor is an NMOS transistor. The skilled person will appreciate that the circuit could also employ a PMOS driver transistor and a negative supply.

A switch transistor 260 is controlled by a row conductor 262 and, when switched on, allows a voltage on capacitor 258 to be set by applying a voltage signal to column conductor 264 or a given charge to be injected into the capacitor. Additionally, however, a photodiode 266 is connected across storage capacitor 258 so that it is reverse biased. Thus photodiode 266 is essentially non-conducting in the dark and exhibits a small reverse conductance depending upon the degree of illumination. The physical structure of the pixel is arranged so that OLED 254 illuminates photodiode 266, thus providing an optical feedback path 252.

The photocurrent through photodiode 266 is approximately linearly proportional to the instantaneous light output level from OLED 254. Thus the charge stored on capacitor 258, and hence the voltage across the capacitor and the brightness of OLED 254, decays approximately exponentially over time. The integrated light output from OLED 254, that is the total number of photons emitted and hence the perceived brightness of the OLED pixel, is thus approximately determined by the initial charge stored on capacitor 258.

Improvements to the circuit of FIG. 2*b,* in which every pixel of the display needs refreshing every frame, are described in the applicant's co-pending UK patent applications 0126120.5 and 0126122.1, both filed on 31 Oct. 2001.

Figure 3A:
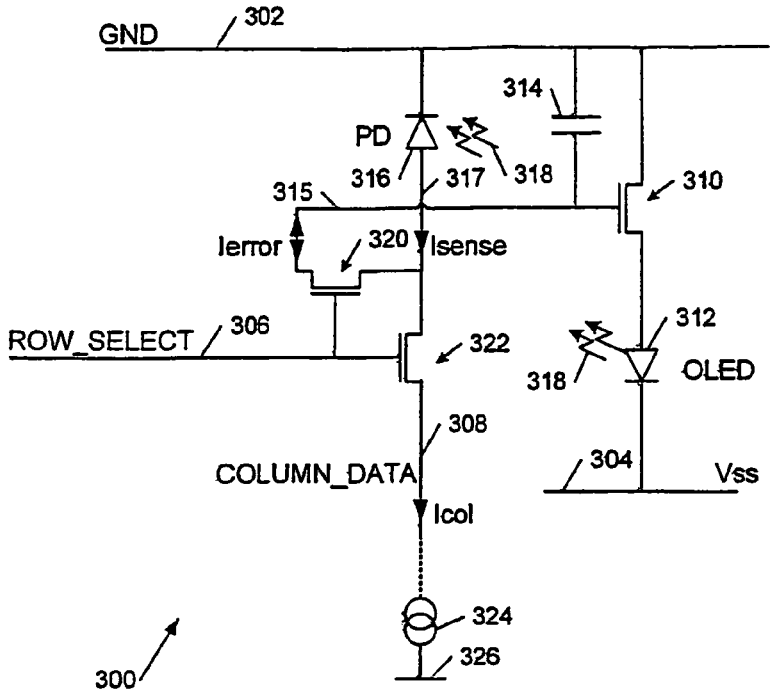

FIG. 3*a* shows a current-controlled organic LED active matrix pixel driver circuit 300 with optical feedback according to as described in patent application number 0126120.5. In the circuit of FIG. 3*a*, and in the circuits described later, the transistors of the active matrix pixels are preferably PMOS.

In an active matrix display typically each pixel is provided with such a pixel driver circuit. Further driver circuitry (not shown in FIG. 3*a*) is provided to address the pixels row-by-row, to set each row at the desired brightness. To power and control the pixel driver circuitry and OLED display element such an active matrix display is provided with a grid of electrodes including, as shown in FIG. 3*a,* a ground (GND) line 302, a power or $V_{ss}$ line 304, a row select line 306 and a column data line 308. Each column data line is connected to a programmable constant current reference source (or sink) 324. This is not part of the driver circuitry provided for each pixel but instead comprises part of the display driver circuitry provided for each column. Reference current generator 324 is programmable so that it can be adjusted to a desired level to set a pixel brightness, as described in more detail below.

The pixel driver circuit 300 comprises a driver transistor 310 connected in series with an organic LED display element 312 between the GND 302 and $V_{ss}$ 304 lines. A storage capacitor 314, which may be integrated with the gate of transistor 310, stores a charge corresponding to a memorised gate voltage to control the drive-current through OLE element 312. Control circuitry for the driver comprises two switching transistors 320, 322 with a common gate connection coupled to row select line 306. When row select line 306 is active these two switch transistors are on, that is the switches are "closed", and there is a relatively low impedance connection between lines 315, 317 and 308. When row select line 306 is inactive transistors 320 and 322 are switched off capacitor 314 and the gate of transistor 310 are effectively isolated, and any voltage set on capacitor 314 is memorised.

A photodiode 316 is coupled between GND line 302 and line 317 so that it is reverse biased. The photodiode is physically arranged with respect to the OLED display element 312 such that an optical feedback path 318 exists between OLED 312 and photodiode 316. In other words, OLED 312 illuminates photodiode 316 and this allows an illumination-dependent current to flow in a reverse direction through photodiode 316, that is from GND line 302 towards $V_{ss}$. As the skilled person will understand, broadly speaking each photon generates an electron within photodiode 316 which can contribute to a photocurrent.

Column data line 308 is coupled, at the end of a column, to programmable reference current generator 324. This attempts to cause a reference current, which will be referred to as $I_{col}$, to flow to off-pixel $V_{ss}$ connection 326. Line 317 may be referred to as a current sense line, passing a current $I_{sense}$ and line 315 may be referred to as a control line, passing a current $I_{error}$ to set a voltage on capacitor 314 to control OLED 312. When row select line 306 is active and transistors 320 and 322 are on $I_{col}=I_{sense}+I_{error}$ and thus a current $I_{error}$ flows either onto or off capacitor 314 until OLED 312 illuminates photodiode 316 such that $I_{sense}=I_{col}$. At this point row select line 306 can be deactivated, and the voltage required for this level of brightness is memorised by capacitor 314.

Similarly to FIG. 2*a*, as drawn the maximum (most negative) gate voltage drive for transistor 310 is $V_{ss}$ and to permit a greater (more negative) drive off-pixel connection 326 may be connected to a drive voltage $V_{drive}$ more negative than $V_{ss}$.

The time required for the voltage on capacitor 314 to stabilise depends upon a number of factors, which may be varied in accordance with the desired device characteristics, and may be a few microseconds. Broadly speaking a typical OLED drive current is of the order of 1 μA whilst a typical photocurrent is around 0.1% of this, or of the order of 1 nA (in part dependent upon the photodiode area). It can therefore be seen that the power handling requirements of transistors 320 and 322 are negligible compared with that of the drive transistor 310, which must be relatively large. To speed up the settling time of the circuit it is preferable to use a relatively small value for capacitor 314 and a relatively large area photodiode to increase the photocurrent This also helps reduce the risk of noise and stability at very low brightness levels associated with stray or parasitic capacitance on column data line 308.

Figure 3B:
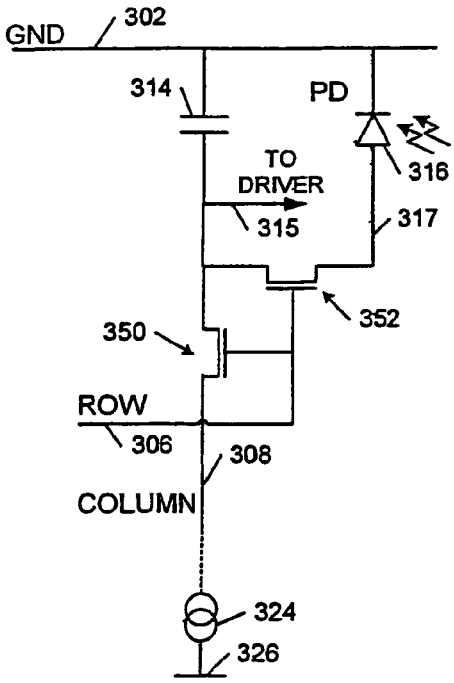
Figure 3C:
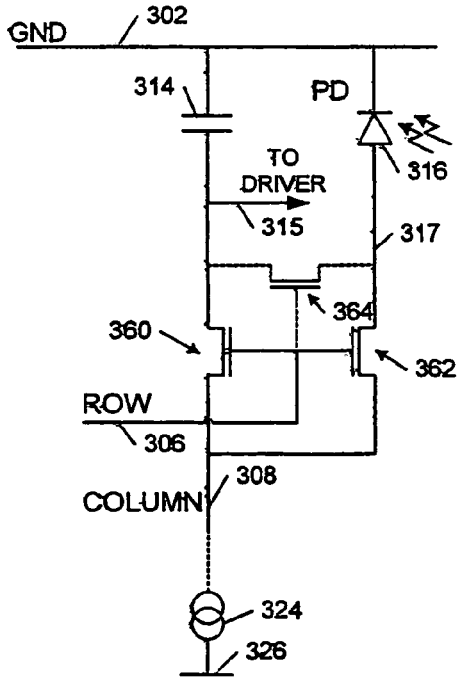

FIGS. 3*b* and 3*c* show a portion of the circuit of FIG. 3*a* illustrating different possible configurations for switching transistors corresponding to switching transistors 320 and 322 of FIG. 3*a*. The purpose of transistors 320 and 322 is to couple lines 315, 317 and 308 when row select line 306 is active and it will be appreciated that there are three different ways of connecting three nodes using two controllable switches.

In FIG. 3*b* a first switching transistor 350 is connected between lines 308 and 315 and a second switching transistor 352 is connected between lines 315 and 317. Both transistors 350 and 352 are controlled by row select line 306. In FIG. 3*c* a first switching transistor 360 is connected between lines 308 and 315 and a second switching transistor 362 is connected between lines 308 and 317. Optionally a third switching transistor 364 may be connected between lines 315 and 317. The two (or three) switching transistors are all controlled by row select line 306.

The preferred photosensor is a photodiode which may comprise a PN diode in TFT technology or a PIN diode in crystalline silicon. However other photosensitive devices such as photoresistors and photosensitive bipolar transistors and ETs may also be employed, providing they have a characteristic in which a photocurrent is dependent upon their level of illumination.

The active matrix pixel circuits as described use PMOS transistors but the circuits may be inverted and NMOS employed or, alternatively, a combination of PMOS and NMOS transistors or bipolar transistors may be used. The transistors may-comprise thin film transistors (TFTs) fabricated from amorphous or polysilicon on a glass or plastic substrate or conventional CMOS circuitry may be used. Alternatively plastic transistors such as those described in WO 99/54936 may be employed, and he photodiode may comprise a reverse biased OLED to allow the entire circuitry to be fabricated from plastic. Although PMOS is preferably for the amorphous pixel driver transistors, external integrated circuit drivers fabricated on conventional silicon will generally employ NMOS transistors.

Figure 4:
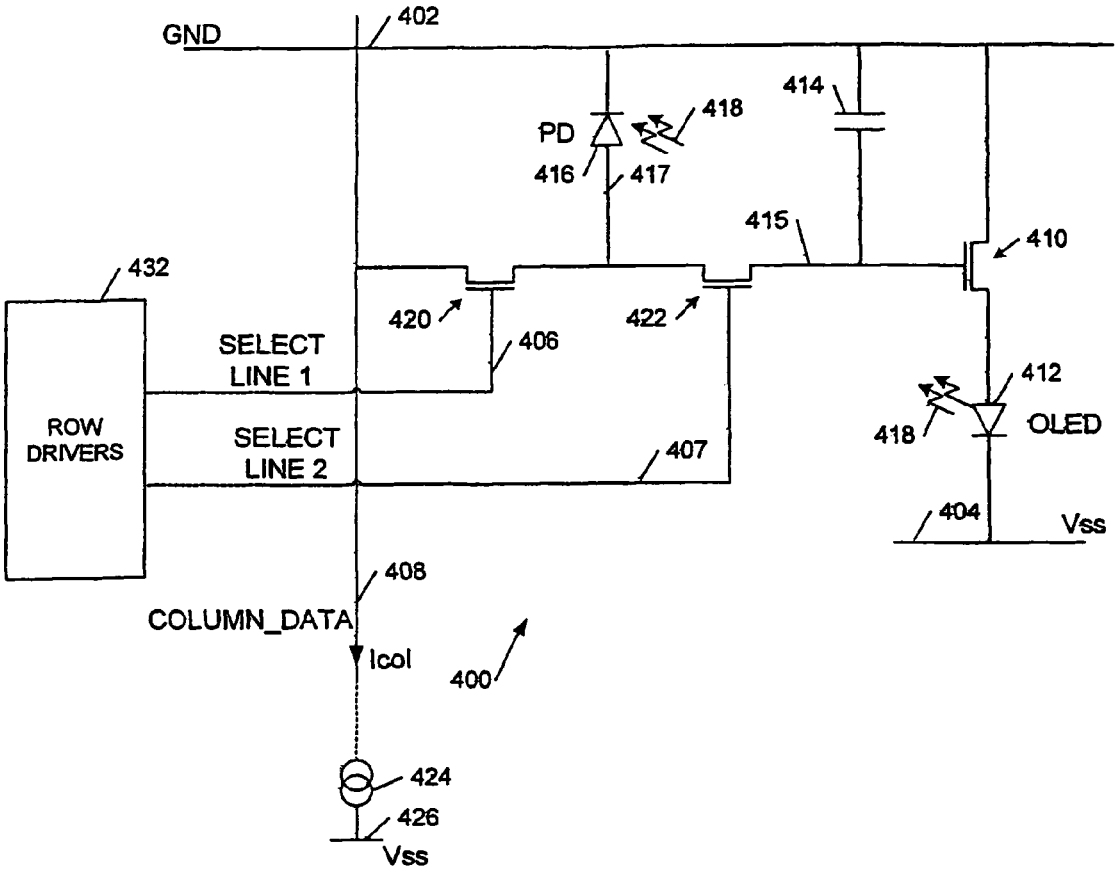

Referring now to FIG. 4, this shows an organic LED active matrix pixel driver circuit 400 which can be operated in a number of different modes, as described in UK patent application number 0126122.1.

As shown, the pixel driver circuit is provided with a ground (GND) line 402, a power or $V_{ss}$ line 404, row select lines 406, 407 and a column data line 408. A reference current source (or sink) 424, preferably a programmable constant current generator, allows a current in column data line 408 to be adjusted to a desired level to set a pixel brightness. In other arrangements, however, a programmable voltage generator may be used additionally or alternatively to current generator 424, to allow the driver circuit to be used in other modes. Row driver circuitry 432 controls the first and second row select lines 406 and 407 according to the operating mode of the pixel driver circuitry.

The pixel driver circuit 400 comprises a driver transistor 410 connected in series with an organic LED display element 412 between the GND 402 and $V_{ss}$ 404 lines. A storage capacitor 414, which may be integrated with the gate of transistor 410, stores a charge corresponding to a memorised gate voltage to control the drive current through OLED element 412.

Control circuitry for the pixel driver comprises two switching transistors 420, 422 with separate, independently controllable gate connections coupled to first and second select lines 406 and 407 respectively. A photodiode 416 is coupled to a node 417 between transistors 420 and 422. Transistor 420 provides a switched connection of node 417 to column data line 408. Transistor 422 provides a switched connection of node 417 to a node 415 to which is connected storage capacitor 414 and the gate of transistor 410. Again, preferably all the transistors of the pixel driver are PMOS.

As before a photodiode 416 is coupled between GND line 402 and line 417 so that it is reverse biased. The photodiode is physically arranged with respect to the OLED display element 412 to provide an optical feedback path 418, so that an illumination-dependent current flows in a reverse direction through photodiode 416, that is from GND line 402 towards $V_{ss}$.

When first select line 406 is active transistor 420 is on, that is the switch is "closed" and there is a relatively low impedance connection between column data line 408 and node 417. When first select line 406 is inactive transistor 420 is switched off and photodiode 416 is effectively isolated from column data line 408. When second select line 407 is active transistor 422 is switched on and nodes 415 and 417 are coupled; when second select line 407 is inactive transistor 422 is switched off and node 415 is effectively isolated from node 417.

It can be seen that when both transistors 420 and 422 are switched offside both the first and second select lines 406 and 407 are inactive) photodiode 416 is effectively isolated from the remainder of the driver circuitry. Similarly when transistor 422 is off(second select line 407 is inactive) and transistor 420 is on (first select line 406 is active) photodiode 416 is effectively connected between ground GND) line 402 and column data line 408. In this way photodiode 416 may be effectively isolated from the remainder of the driver circuitry and used as a sensor.

The active matrix pixel driver circuitry 400 may be operated in a current-controlled mode with optical feedback, in a voltage-controlled mode with optical feedback, and in a voltage-controlled mode without optical feedback. Any or all of these modes may be employed with a light measurement mode to make an ambient light measurement before data is written to a pixel, or to input an image after data is written to a pixel.

The pixel driver circuit has a first mode of operation which, broadly speaking, is a previously described. In this mode first and second select lines 406 and 407 are connected together or driven in tandem by row drivers 432 so that the circuit operates as a current-controlled driver with optical feedback. As before, the programmable reference current generator 424 attempts to cause a reference current $I_{col}$ to flow to off-pixel $V_{ss}$ connection 426. Again off-pixel connection 426 may be connected to a drive voltage $V_{drive}$ more negative than $V_{ss}$ to permit a greater (more negative) drive to the gate of transistor 410.

In this first mode line 417 may be referred to as a current sense line, passing a current $I_{sense}$ and line 415 may be referred to as a control line, passing a current $I_{error}$ to set a voltage on capacitor 414 to control OLED 412. As before, when first and second (row)select lines 406 and 407 are active transistors 420 and 422 are on and $I_{col}=I_{sense}+I_{error}$ and thus the current $I_{error}$ flows either onto or off capacitor 414 until OLED 412 illuminates photodiode 416 such that $I_{sense}=I_{col}$. At this point the first and second row select lines 406 and 407 can be deactivated and the voltage required for this level of brightness is memorised by capacitor 414.

In a second mode the pixel driver circuitry 400 is voltage controlled and operates in a similar manner to the prior art circuit of FIG. 1*b,* that is without optical feedback. As in the first mode of operation, the first and second select lines are connected together or driven in tandem by row drivers 432 but instead of column data line 408 being driven by a reference current generator 424, line 408 is driven by a voltage reference source, programmable to adjust the pixel brightness. The voltage source preferably has a low internal resistance to approximate a constant voltage source.

In this second mode of operation when the first and second select lines 406 and 407 are active capacitor 414 is coupled to column data line 408 and is therefore charged to the voltage output by the reference voltage generator. The small reverse current through photodiode 416 due to illumination by OLED 412 has a substantially no effect on the voltage on line 408 because of the low internal resistance of the voltage source. Once capacitor 414 has been charged to the required voltage transistors 420 and 422 are switched off by deasserting the first and second select lines 406 and 407, so that capacitor 414 does not discharge through photodiode 416. In this mode of operation the pair of transistors 420 and 422 effectively perform the same function as transistor 162 in the circuit of FIG. 1*b*.

In a third mode of operation the circuit is again driven by a programmable reference voltage source but the second select line is controlled so that it is always active (and hence so that transistor 422 is always on) whilst OLED 412 is on. In this way photodiode 416 is connected across storage capacitor 414 so that the circuit operates in substantially the same way as the circuit of FIG. 2*b* described above, transistor 420 performing the function of transistor 260 in FIG. 2*b*. In a simple embodiment the second select line 407 may simply be tied to a fixed voltage supply to ensure this line is always active. However transistor 422 need only be on long enough to ensure that capacitor 414 has enough time to discharge and thus it is still possible in this mode to switch off transistor 422 at times to allow photodiode 416 to be connected between lines 402 and 408 by transistor 420 and used as a sensor.

In an improvement of this mode of operation the programmable reference voltage source can be arranged to deliver a predetermined charge to capacitor 414 sine, when photodiode 416 is connected across capacitor 414, it is the charge on capacitor 414 which determines the apparent brightness of OLED 412 rather than the voltage itself Delivering a predetermined charge to capacitor 414, rather than charging the capacitor to a reference voltage, reduces the effect of non-linearities in the charge-voltage characteristic of capacitor.

The pixel driver circuitry 400 may be controlled to provide a measurement cycle before pixel illumination data is written to the circuit to set the brightness of OLED 412. In the above described modes it will be recognised that the first select line 406 in effect operates as a row select line whilst the second select line 407 operates as a combined mode and row select line. Thus, for example, in order to perform a (write black)—(measure)—(write level) cycle for a selected row the first select line 406 is held active whilst the second select line 407 is toggled from active during a write cycle to inactive or deasserted during a measure cycle.

Figure 5A:
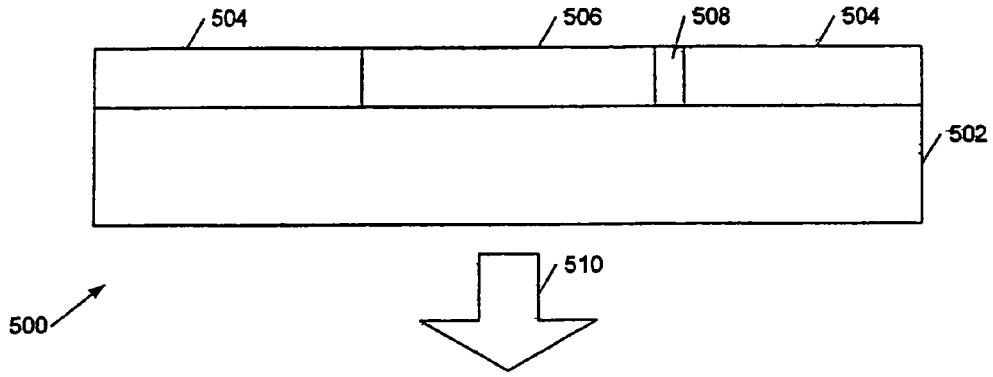
Figure 5B:
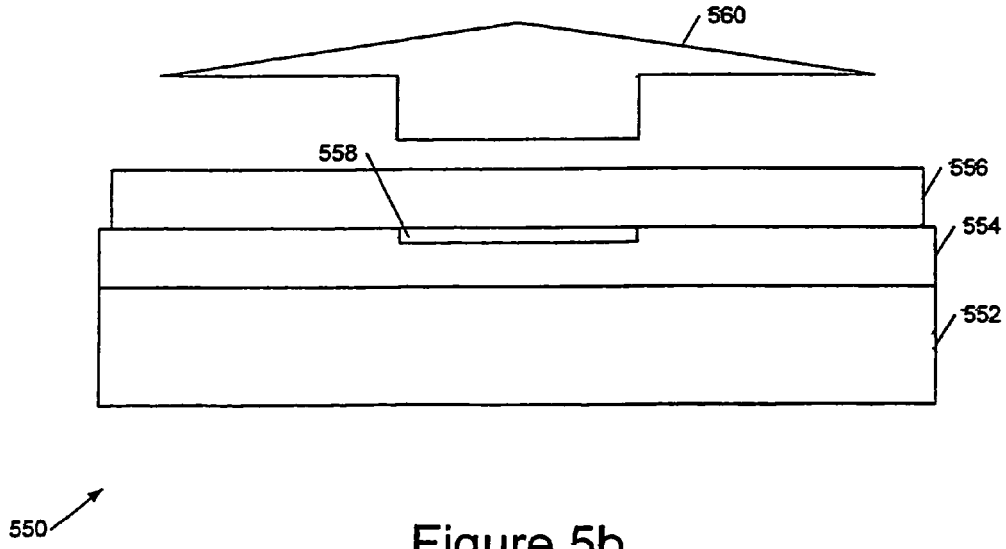

FIG. 5 shows (not to scale) two alternative physical structures for OLED pixel driver circuits incorporating optical feedback FIG. 5*a* shows a bottom-emitting structure 500 and FIG. 5*b* shows a top-emitter 550.

In FIG. 5*a* an OLED structure 506 is deposited side-by-side with polysilicon pixel driver circuitry 504 on a glass substrate 502. The driver circuitry 504 incorporates a photodiode 508 to one side of the OLED structure 506. Light 510 is emitted through the bottom (anode) of the substrate.

FIG. 5*b* shows a cross section through an alternative structure 550 which emits light 560 from its top (cathode) surface. A glass substrate 552 supports a first layer 554 comprising the driver circuitry and including a photodiode 558. An OLED pixel structure 556 is then deposited over the driver circuitry 554. A passivation or stop layer may be included between layers 554 and 556. Where the pixel driver circuitry is fabricated using (crystalline) silicon rather than polysilicon or amorphous silicon a structure of the type shown in FIG. 5*b* is required and substrate 552 is a silicon substrate.

In the structures of FIGS. 5*a* and 5*b* the pixel driver circuitry may be fabricated by conventional means. The organic LEDs may be fabricated using either ink jet deposition techniques such as those described in EP 880303 to deposit polymer-based materials or evaporative deposition techniques to deposit small molecule materials. Thus, for example, so-called micro-displays with a structure of the type illustrated in FIG. 5*b* may be fabricated by ink jet printing OLED materials onto a conventional silicon substrate on which CMOS pixel driver circuitry has previously been fabricated.

With all these arrangements, however, it is generally desirable to reduce the power consumption of the active matrix display, and more particularly of the combination of the display and its (generally external) driver circuitry. It is flier desirable to reduce the maximum required power supply voltage for the display plus driver combination.

According to the present invention there is therefore provided a display driver for an electroluminescent display, the display comprising a plurality of electroluminescent display elements each associated with a display element driver circuit, each said display element driver circuit including a drive transistor having a control connection for driving the associated display element in accordance with a voltage on the control connection, the display driver comprising at least one display element brightness controller to provide an output to drive a said control connection to control the electroluminescent output from a said display element; a voltage sensor to sense the voltage on a said control connection; and a power controller for controlling an adjustable power supply for providing an adjustable voltage to said electroluminescent display to power said drive transistors for driving said display elements, said power controller being configured to provide a control signal to adjust said power supply voltage in response to said sensed voltage.

Sensing the voltage on a drive transistor control connection allows the strength of drive to be gauged and thus allows excess power dissipation in a drive transistor to be reduced by adjusting, and preferably reducing, the power supply accordingly. More particularly where the voltage on a control connection is less than the maximum available the voltage on the control connection may be increased thus permitting a reduced voltage, power supply for the electroluminescent display elements and their associated driver transistors. The voltage on a said control connection will generally be sensed indirectly by sensing the voltage on a control line of the display, such as a column (or row) control line of an active matrix display. Depending upon the type of drive to the display, that is for example whether current or voltage drive is employed, an adjustment to the power supply voltage may bring about an automatic adjustment to the voltage on the drive transistor control connection.

In a preferred embodiment the drive transistor comprises a FET (or MOSFET) and the control connection comprises a gate connection of the transistor. Thus the voltage sensor senses the gate voltage of a drive transistor, and this may be accomplished by monitoring the voltage on a control line connection to the display. Even where the display element brightness controller provides a current rather than a voltage drive, sensing the voltage on a (current) control line nonetheless may, in effect, sense the gate voltage of a drive transistor. Thus the display driver may be employed with a conventional, unmodified active matrix display to increase the power efficiency of the display plus driver combination.

To optimise the efficiency of the display and driver combination it is preferable to use as small power supply voltage as possible. The required power supply voltage will, in part, be determined by the displayed image and hence by the data written to the display. More particularly the minimum usable power supply voltage will, in part, be determined by the power supply requirements of the brightest illuminated display element, and preferably the power supply voltage is no greater than required by this(or these) display element (or elements). However the minimum usable power supply voltage will also depend upon how hard the drive transistors may be driven on their control connections and, more particularly by the maximum drive available for the brightest illuminated pixel. It is therefore preferable to adjust the power supply until the control connection or gate voltage increases to the maximum available for driving the display and, as previously mentioned, this gate voltage may be monitored by monitoring a control line of the display. It will be appreciated that, generally speaking, reducing the power supply voltage will have the effect of increasing the control connection voltage since normally there is a mechanism for driving the display to produce a controlled brightness so that when the power supply voltage is reduced the control connection voltage is increased to compensate. This function may be performed by the display element brightness controller. An alternative way of picturing this mechanism is to consider it as control of the control connection or gate voltage to permit a reduction in the power supply voltage, although in practise this is less convenient to implement as a knowledge of the drive transistor characteristics may be required.

It will be appreciated that the brightness of a display element could be monitored, for example using a photodiode, to allow adjustment of the power supply voltage until the brightest illuminated element starts to get dimmer but it has been recognised that brightness information can, in effect, be derived more simply by monitoring a drive level, more particularly a drive transistor control connection voltage. It has also been recognised that this voltage may, in turn, be monitored by monitoring a brightness control connection to the display such as a current or voltage-controlled brightness setting line or connection.

In a preferred embodiment the display is an active matrix display with a plurality of row and column connections, for example, pixel select lines being connected to the row connection and pixel brightness control lines being connected to the column connections. The voltage sensor may then, for example, sense the voltage on a brightness control or column connection.

In one embodiment the brightness controller comprises a substantially constant current generator, preferably adjustable to provide adjustable display element brightness. The constant current generator may comprise either a current source or a current sink. The voltage on a control connection of the display may then be substantially determined by a voltage level (input or output) of the constant current generator, which depends upon a current supplied by the generator. The power controller may then be configured to reduce the power supply voltage when the sensed voltage on a control connection is less in absolute terms (that is ignoring polarity) than a threshold voltage such as a maximum available voltage for driving the display. The sensed voltage for comparison with the threshold voltage preferably comprises a voltage sensed from a display element having a maximum brightness relative to others of the display elements at a given time, that is the brightest illuminated display element. It will be recognised that there may be more than one such pixel and that where the display is, for example, partitioned into sections with different drivers the maximum brightness of a display element in the appropriate partition for the driver may be employed.

In another embodiment the display element driver circuits are similar to the circuit described above with reference to FIG. 2*b,* that is voltage-controlled with a photo diode to provide optical feedback so that the voltage on the drive transistor control connection decays with time. In this embodiment the power controller may be configured to reduce the power supply voltage when the control connection voltage of the brightest illuminated display element has reduced to less than a first threshold value after a predetermined interval such as a line interval, frame interval or other cycle interval. The first threshold value may comprise, for example, a gate-source threshold voltage $V_T$ of a FET or a base emitter voltage $V_{be}$ of a bipolar transistor, or some other threshold value such as 0 volts. Broadly speaking the first threshold value is preferably selected to be substantially equal to a minimum control connection voltage required for the drive transistor to turn on. Preferably the power controller is flier configured to increase the power supply voltage when the control connection voltage has not decayed to less than a second threshold value, preferably equal to the first threshold value, after the predetermined interval.

Embodiments of the display driver may include the adjustable power supply.

In another aspect the invention provides a power controller for a display driver for an electroluminescent display, the display comprising a plurality of electroluminescent display elements each associated with a display element driver circuit, each said display element driver circuit including a drive transistor having a control connection for driving the associated display element in accordance with a voltage on the control connection, the power controller comprising a memory storing processor control code; a processor coupled to the memory for executing said processor control code; a sensed voltage input for sensing a voltage on a said control connection; and a control signal output for controlling an adjustable power supply for providing an adjustable voltage to said electroluminescent display to power said drive transistors for driving said display elements; said processor control code comprising instructions for controlling the processor to read said sensed voltage input and to output a control signal to adjust said power supply in response to said sensed voltage.

The invention also provides a carrier carrying the above-described processor-control code the carrier may comprise any conventional data carrier or storage medium such as a hard or floppy disk, ROM, or CD-ROM or an optical or electrical signal carrier.

In another related aspect the invention provides a method of operating an active matrix electroluminescent display, the display comprising a plurality of pixels each with an associated pixel driver, the display having a power supply and plurality of control lines for setting the brightness of each pixel, the method comprising setting the brightness pixels of the display using said control lines; monitoring control lines of the display, and reducing said power supply responsive to said monitoring.

The control lines may comprise, for example, column (or row) electrode lines of the display, although the skilled person will recognise that the active matrix display need not have pixels in a regular grid pattern. The display may be a colour display and the pixels may be of different colours or the pixels may all be of substantially the same colour, albeit preferably of variable brightness rather than merely on or off. The pixel brightness setting and control line monitoring may be combined.

The display pixels may include either a bipolar or FET (or MOSFET) driver transistor connected in series with an electroluminescent display element. The monitoring may thus monitor a control voltage of a pixel drive transistor, such as a base or gate voltage.

With a voltage-driven pixel driver the monitoring may determine whether the drive transistor control voltage is sufficient, or whether the power supply voltage is sufficient, by determining whether the brightest pixel is bright enough. This may be achieved by monitoring the control voltage of the drive transistor of the brightest illuminated pixel. Alternatively with a current drive in which, broadly speaking, the level of a substantially constant current generator sets the brightness of a pixel, the drive transistor control voltage may be monitored to determine whether or not the drive transistor could be driven harder, thus permitting the power supply voltage to be reduced. The monitoring may therefore comprise determining a maximum pixel brightness of the pixels which are illuminated (rather than, for example, a maximum possible pixel brightness) and the power supply may then be reduced to substantially no more than required by that maximum pixel brightness. Alternatively the power supply may be controlled so that it does not reduce the power supply voltage to less than required for the maximum required pixel brightness.

The minimum required power supply voltage depends upon the control voltage of the drive transistor for the brightest illuminated pixel. The power supply voltage may be set to the minimum required by reducing the power supply voltage until the control voltage of the drive transistor increases to the maximum available control voltage, that is the maximum control voltage which a display driver can provide to the display given the available power supply to the display driver. Thus the reducing may comprise reducing the power supply until the control voltage substantially reaches a maximum available control voltage, for instance a maximum voltage available at a control line of the display at the point of monitoring.

Where a voltage-driven display with optical feedback is employed such that the control voltage decays over time, the monitoring preferably monitors the decayed voltage, for example after a predetermined time such as a frame interval where the voltage decays over a frame interval. The power supply voltage may be reduced if the control voltage, preferably of the brightest illuminated pixel, has decayed to less than a threshold voltage, and may otherwise be increased. In other words if the decayed voltage indicates that the pixel is sufficiently brightly illuminated the power supply voltage may be reduced until it is just sufficient (or just insufficient). As previously mentioned, the threshold voltage may comprise, for example, a threshold voltage of a FET driver transistor or a base emitter voltage of a bipolar driver transistor.

The invention also provides an active matrix display driver configured to operate in accordance with the above-described method. Thus the display driver may incorporate means for setting the brightness of pixels of the display, means for monitoring the control lines of the display, and means for reducing the power supply responsive to the monitoring.

In the above-described aspects of the invention the electroluminescent display is preferably an organic light emitting diode (OLED)-based display, such as a small molecule or polymer OLED-based display.

In all the above aspects of the invention the electro-optic or electroluminescent display element preferably comprises an organic light emitting diode.

Figure 6A:
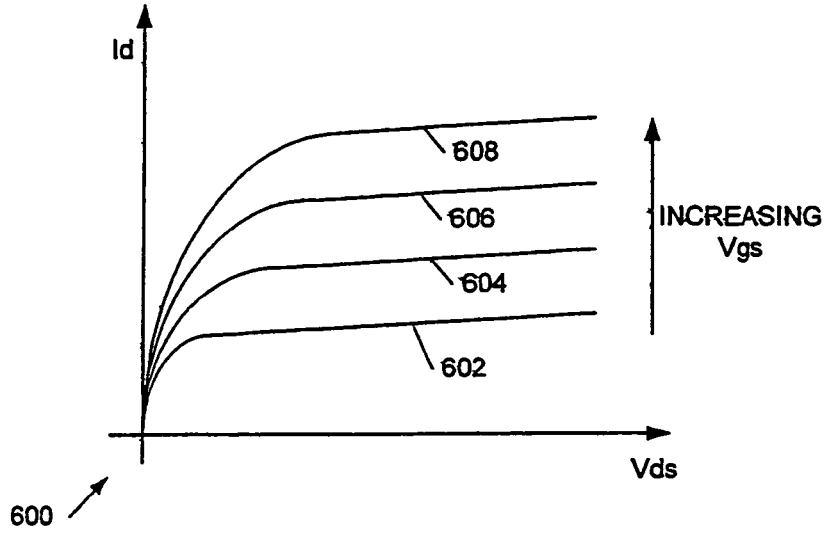
Figure 6C:
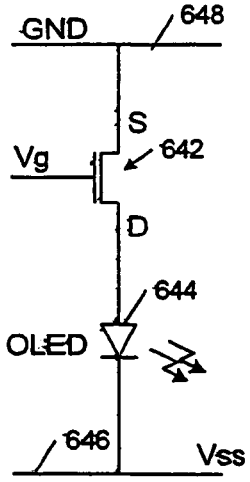
Figure 6B:
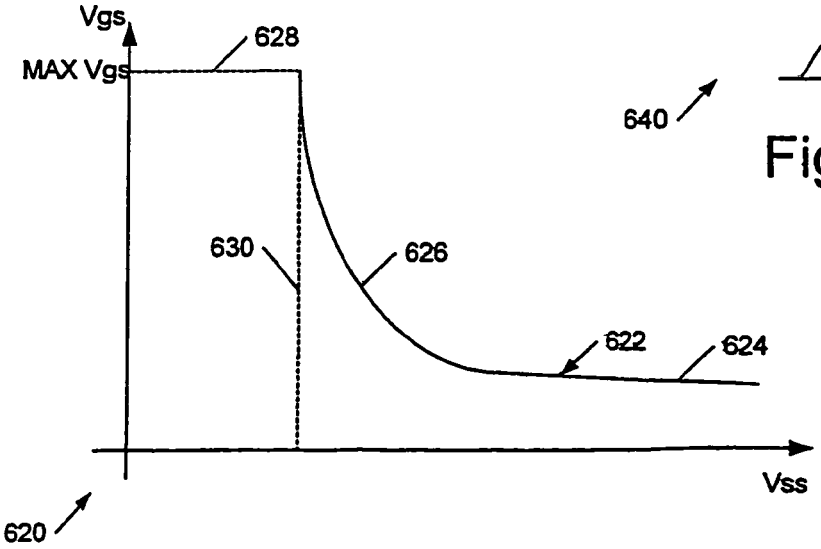
Figure 7A:
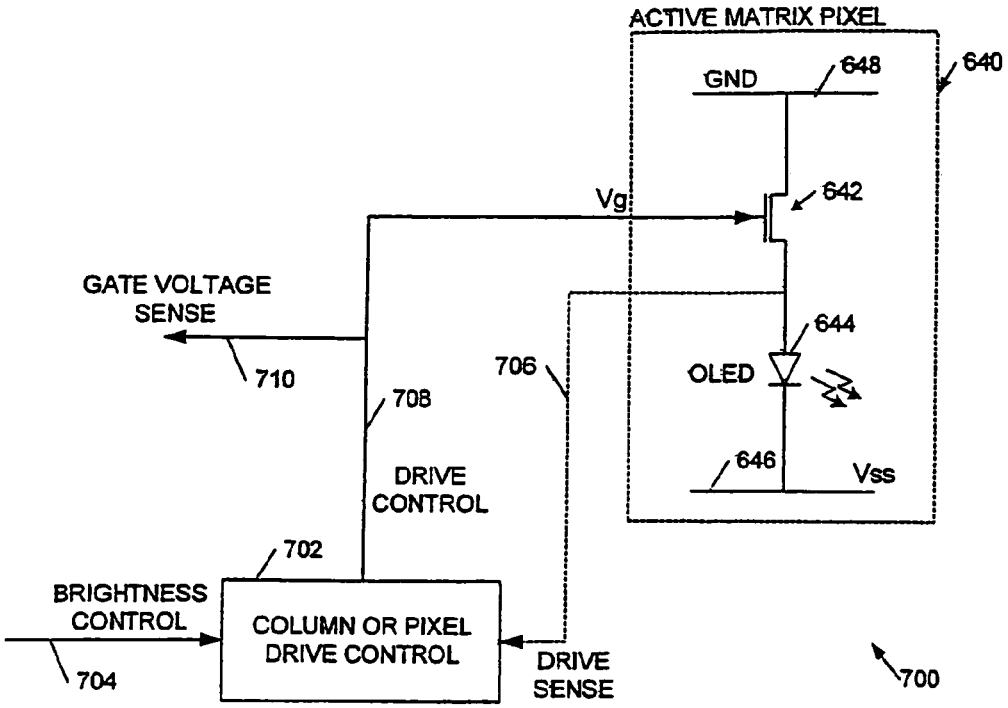
Figure 7B:
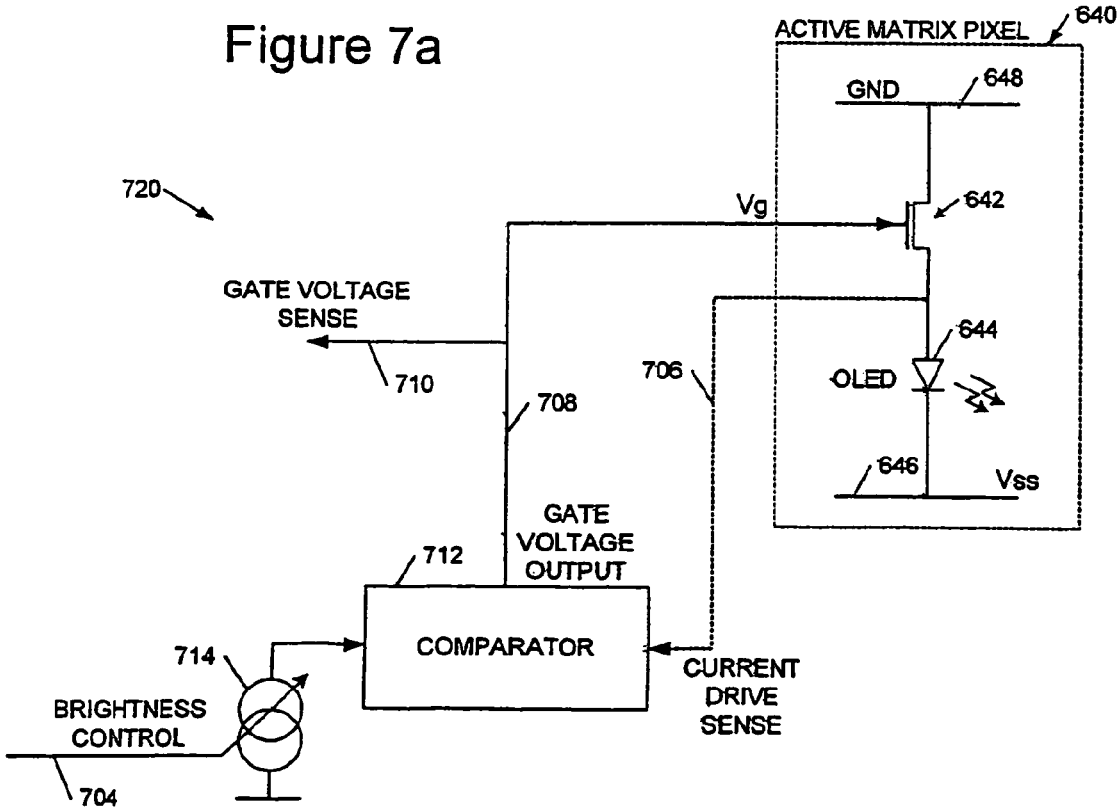
Figure 8:
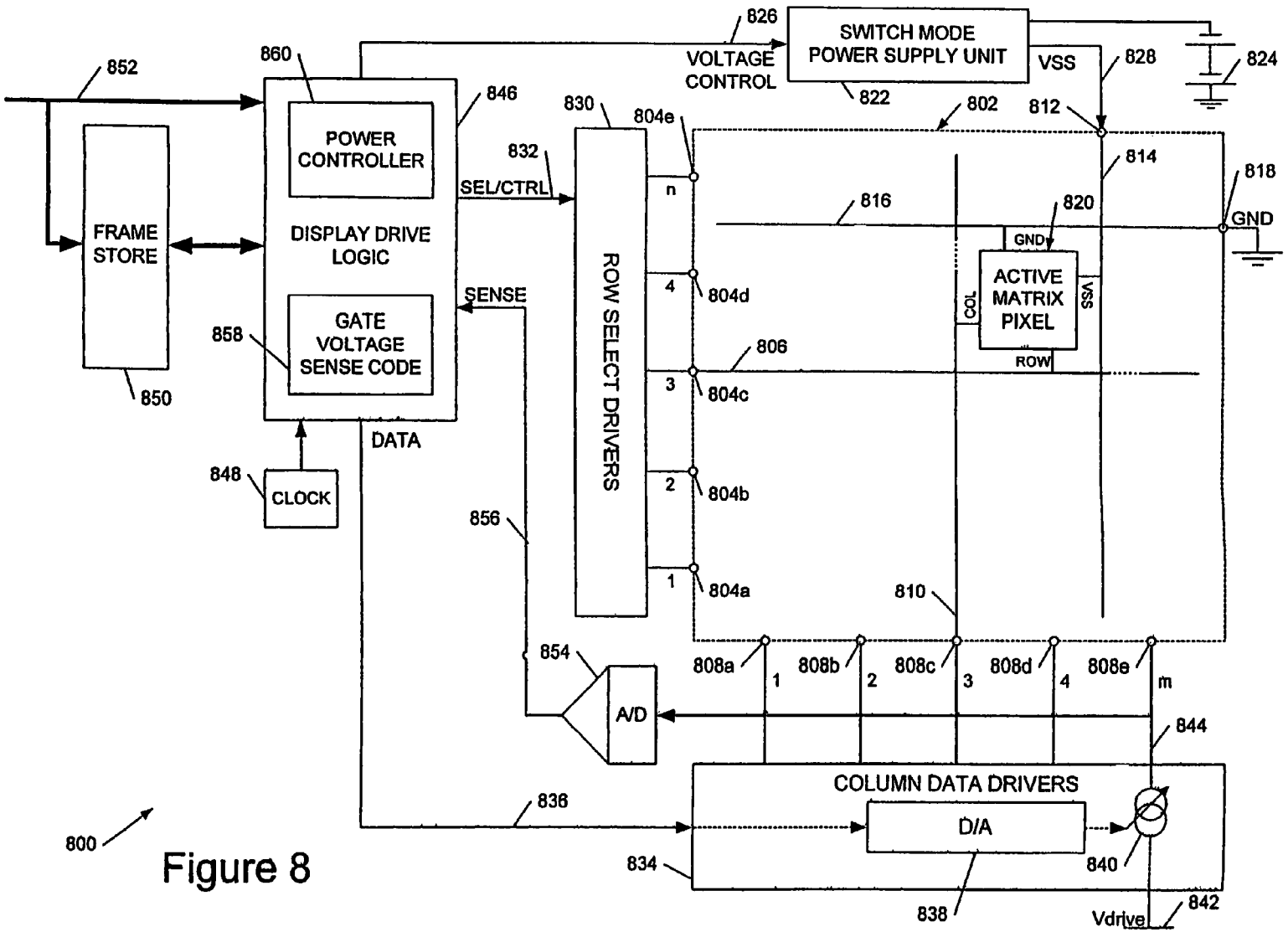
Figure 9A:
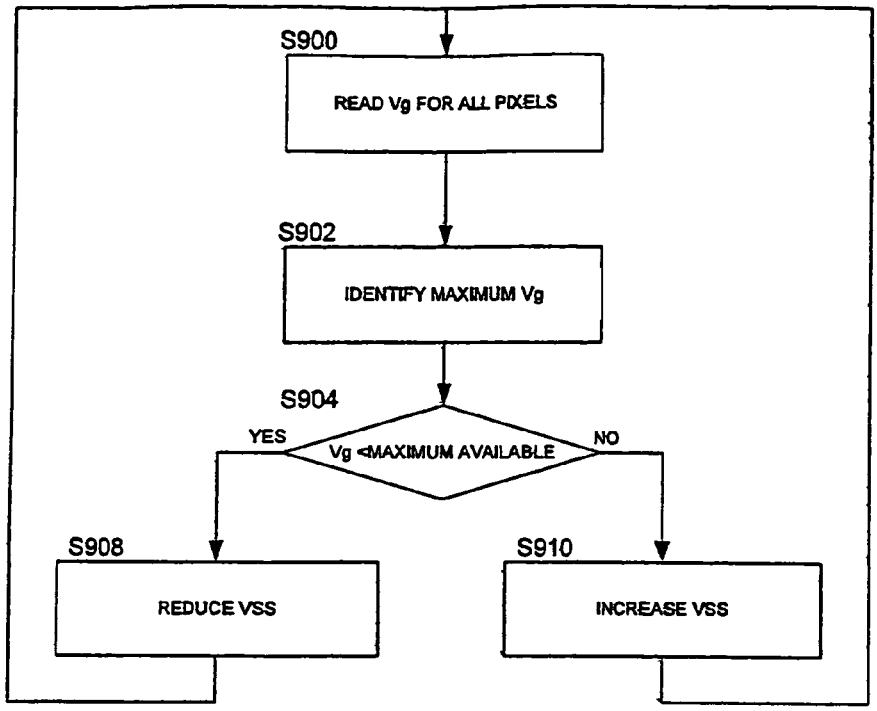
Figure 9B:
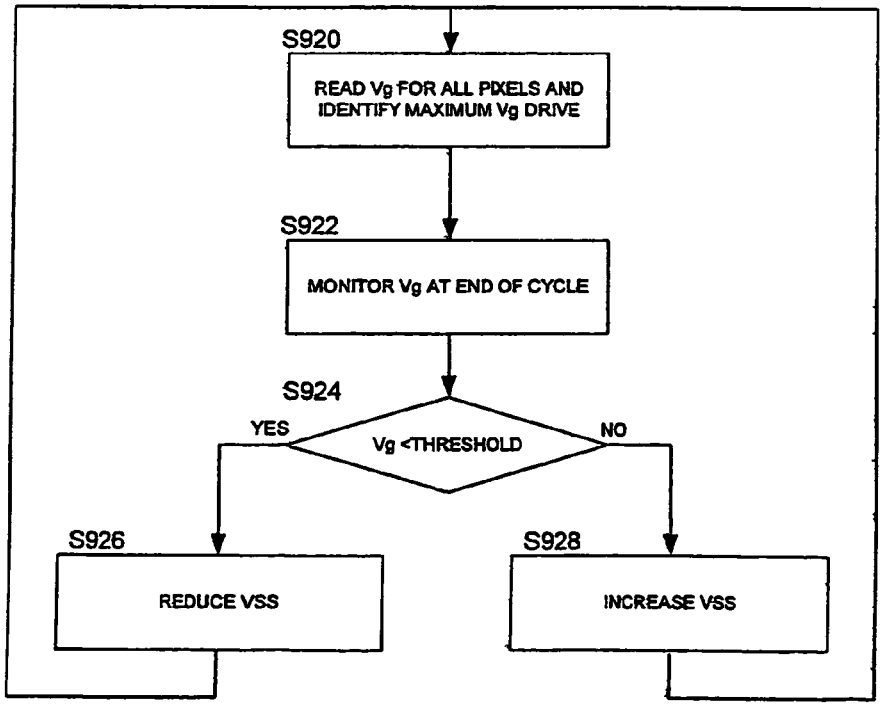
Figure 10:
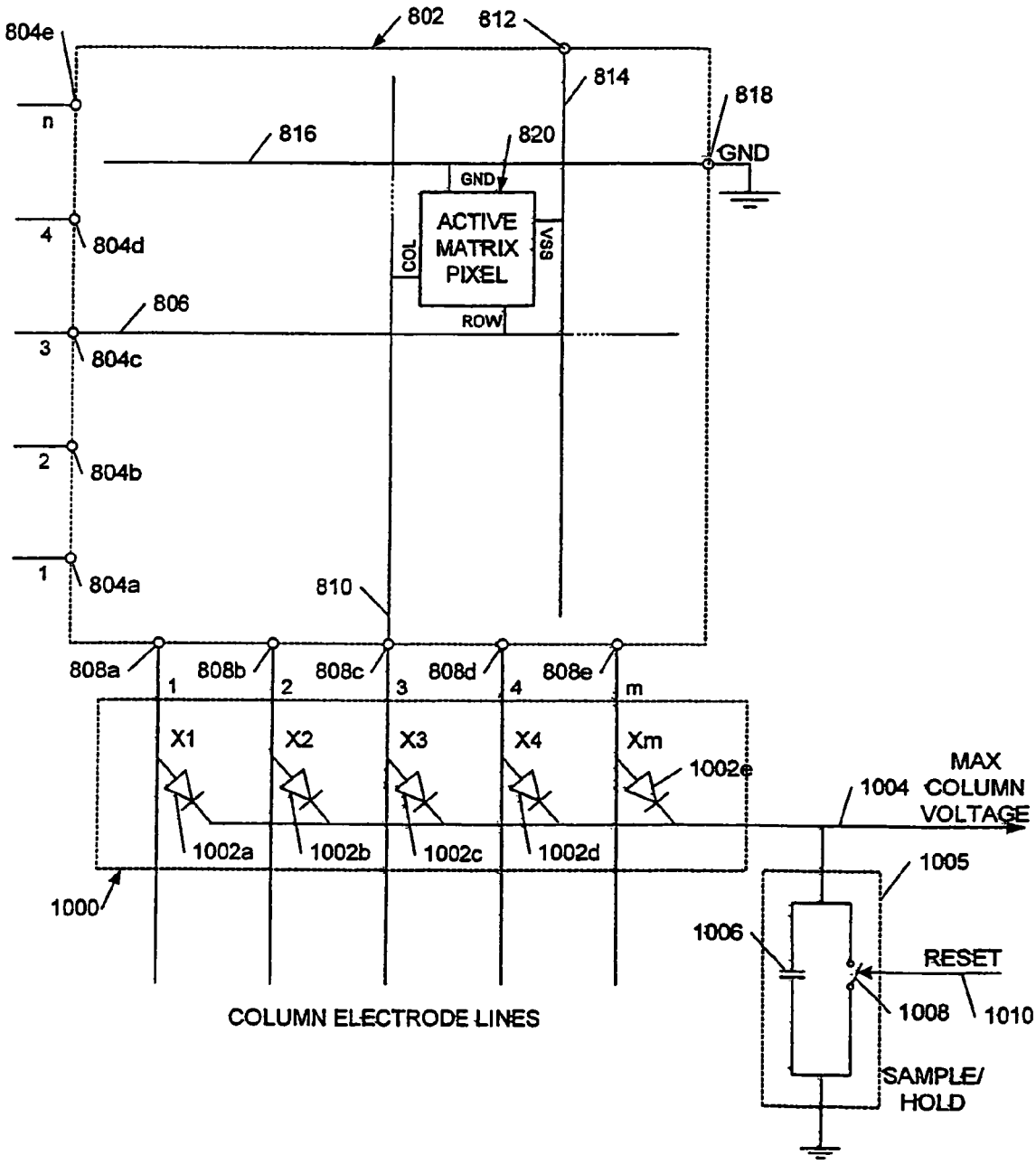

These and other aspects of the invention will now be further described, by way of example only, with reference to the accompanying figures in which:

FIGS. 1*a* and 1*b* show, respectively, a basic organic LED structure, and a typical voltage-controlled OLED driver circuit;

FIGS. 2*a* and 2*b* show, respectively, a current-controlled OLED driver circuit, and a voltage-controlled OLED driver circuit with optical feedback according to the prior art;

FIGS. 3*a* to 3*c* show, respectively, a current-controlled OLED driver circuit with optical feedback, a first alternative switching arrangement, and a second alternative switching arrangement;

FIG. 4 shows a multimode organic LED driver circuit with optical feedback;

FIGS. 5*a* and 5*b* show vertical cross sections through device structures of OLED display elements with driver circuits incorporating optical feedback;

FIGS. 6*a* to 6*c* show, respectively, drain characteristics of an active matrix FET driver transistor, a graph of gate drive voltage against power supply voltage for constant drive current for an active matrix FET driver transistor, and a simplified active matrix pixel driver circuit;

FIGS. 7*a* and 7*b* show active matrix pixel brightness control-circuits;

FIG. 8 shows an active matrix display driver according to an embodiment of the present invention;

FIGS. 9*a* and 9*b* show, respectively, flow diagrams for power supply voltage control procedures for current- and voltage-controlled active matrix pixel driver circuits; and FIG. 10 shows a circuit diagram of a maximum voltage detector and the display of the active matrix display driver of FIG. 8.

Referring now to FIG. 6*a*, this shows drain characteristics 600 for a FET driver transistor of an active matrix pixel driver circuit, such as transistors 212 and 256 of FIGS. 2*a* and 2*b*, transistor 310 of FIG. 3*a* and transistor 401 of FIG. 4. More particularly a set of curves 602, 604, 606, 608 is shown each illustrating the variation of drain current of the FET with drain-source voltage for a particular gate-source voltage. After an initial non-linear portion the curves become substantially flat, and the FET operates in the so-called saturation region. With increasing gate source voltage the saturation drain current increases; below a threshold gate-source voltage $V_T$ the drain current is substantially 0. Typical values of $V_T$ are between 1V and 6V. Broadly speaking the FET acts as a voltage controlled current limiter.

FIG. 6*c* shows a drive portion 640 of a typical active matrix pixel driver circuit. A PMOS driver FET 642 is connected in series with an organic light emitting diode 644 between a ground line 648 and a negative power line $V_{ss}$ 646. FIG. 6*b* relates to the circuit of FIG. 6*c* and shows a graph 620 of gate-source voltage against $V_{ss}$, curve 622 illustrating the variation of $V_{gs}$ with $V_{ss}$ for a constant drain current, that is a constant current through OLED 644. Curve 622 comprises a substantially flat portion 624 corresponding to the flat portions of curves 602-608 and a non-linear portion 626. Dashed lines 628 and 630 correspond to a maximum available $V_{gs}$.

It will be appreciated from the circuit of FIG. 6*c* that, for a given OLED drive current, the greater $V_{ss}$ the greater the excess (waste) power dissipation in driver transistor 642. It is therefore preferable to reduce $V_{ss}$ as much as possible to reduce this excess dissipated power. However it can be appreciated from graph 620 that there is a limit, as indicated by dashed line 630, below which $V_{ss}$ may not be reduced, this limit being determined by the maximum available $V_{gs}$ and the required OLED drive voltage.

Still referring to FIG. 6*b,* as $V_{ss}$ decreases initially $V_{gs}$ changes little and, broadly speaking the operating point of driver transistor 642 moves along the flat portion of one of curves 602, 608 shown in FIG. 6*a*. However as $V_{ss}$ continues to decrease $V_{gs}$ must increase to maintain a constant $I_d$ and hence a constant drive current through OLED 644. The driver circuit operates with optimum efficiency when $V_{ss}$ is no greater than necessary, in other words when the supply voltage is not substantially greater than that needed to provide a desired OLED drive current when driver transistor 642 is driven with the maximum available drive voltage. The greater $V_{ss}$ the greater $I_d$ and hence the greater the OLED drive current although it will be recognised that there will come a point at which FET 642 no longer limits the drive current through OLED 64, instead the internal resistance of the OLED and other factors dominating to limit the current Referring next to FIG. 7*a,* this shows a conceptual circuit diagram of a brightness control circuit 700 for the active matrix pixel driver 640 of FIG. 6*c*. A drive control circuit 702 is provided either for each pixel or for a column for row) of the active matrix display. The drive control circuit 702 has a brightness control input 704 and a drive control output 708 driving the gate of transistor 642 with a voltage $V_g$. This gate voltage may be sensed by means of a connection 710 to drive control output 708; in a practical circuit connection 710 may be indirect, for example via one or more switching transistors. Drive control circuit 702 also has a drive sense input 706, for example to sense the drive current through OLED 644 either directly or indirectly, for example by sensing current through a photodiode optically coupled through OLED 644. Sensing arrangements have been previously been described with reference to FIGS. 2*a,* 3 and 4. The connection to drive sense input 706 is shown as a dashed line since although shown conceptually as tapping a point between transistor 642 and OLED 644 in practice the sensing arrangement generally includes intervening components, or may not comprise the physical connection shown.

FIG. 7*b* shows a more specific conceptual circuit 720 based on the arrangement of FIG. 7*a* In FIG. 7*b* the function of drive control circuit 702 is performed by a current comparator 712, drive sense input 706 is a current drive sense input, and brightness control line 704 controls an adjustable constant current generator 714. Comparator 712 compares the sensed drive current with the constant current from current (source or sink) generator 714 and provides a gate voltage output 708, for example to maintain the current sensed on input 706 substantially equal to the current set by constant current generator 714. In practice the current to voltage conversion may be implemented by a capacitor. As before a comparator 712 may be provided for each pixel or for a set of pixels, for example for each column of the display.

FIG. 8 shows a block diagram 800 of a display driver for an active matrix display 802, configured to control $V_{ss}$ in accordance with the available active matrix pixel drive voltage to increase the power efficiency of the display plus driver combination.

In FIG. 8 the active matrix display 802 has a plurality of row electrodes 804*a-e* and a plurality of column electrodes 808*a-e* each connecting to internal respective row and column lines 806, 810 of which, for clarity, only two are shown. Power ($V_{ss}$) 812 and ground 818 connections are also provided, again connected to respective internal conducting traces 814 and 816 to provide power to the pixels of the display. For clarity a single pixel 820 is illustrated, connected as shown to $V_{ss}$, ground, row, and column lines 814, 816, 806, and 810. It will be recognised that in practice a plurality of such pixels is provided generally, but not necessarily, arranged in a rectangular grid and addressed by row and column electrodes 804, 808. The active matrix pixel 820 may comprise any conventional active matrix pixel driver circuit, such as the previously described circuits pixel driver circuits 200, 250, 300 and 400.

In operation each row of active matrix display 802 is selected in turn by appropriately driving row electrodes 804 and, for each row, the brightness of each pixel in a row is set by driving, preferably simultaneously, column electrodes 808 with brightness data. This brightness data as described above, may comprise either a current or a voltage. Once the brightnesses of the pixels in one row have been set the next row may be selected and the process repeated, the active matrix pixels including a memory element, generally a capacitor, to keep the row illuminated even when not selected. Once data has been written to the entire display, the display only needs to be updated with changes to the brightness of pixels.

Power to the display is provided by a battery 824 and a power supply unit 822 to provide a regulated $V_{ss}$ output 828. Power supply 822 has a voltage control input 826 to control the voltage on output 828. Preferably power supply 822 is a switch mode power supply with rapid control of the output voltage 828, typically on a microsecond time scale where the power supply operates at a switching frequency 1 MHz or greater. Use of a switch mode power supply also facilitates use of a low battery voltage which can be stepped up to the required $V_{ss}$ level, thus assisting compatibility with, for example low voltage consumer electronic devices.

The row select electrodes 804 are driven by row select drivers 830 in accordance with a control input 832. Likewise the column electrodes 808 are driven by column data drivers 834 in response to a data input 836. In the illustrated embodiment each column electrode is driven by an adjustable constant current generator 840, in turn controlled by a digital-to-analogue converter 838 coupled to input 836. For clarity only one such constant current generator is shown.

The constant current generator 840 has a current output 844 to source or sink a substantially constant current The constant current generator 840 is connected to a power supply drive $V_{drive}$ 842, which may be equal to (and connected to) $V_{ss}$ but which is preferably greater than $V_{ss}$ (in this example, more negative than $V_{ss}$) to allow active matrix pixel 820 to be driven harder than $V_{ss}$.

As the skilled person will appreciate, constant current generator 840 in effect adjusts the voltage on output 844 in order to attempt to maintain a substantially constant current in line 844. Current generator 840 has a limit to the voltage it can provide which is termed (output voltage) compliance limit. The maximum constant current which can be supplied in line 844 is determined by the level of $V_{drive}$ 842 and the compliance of the constant current generator. Any constant current generator may be employed, but a particularly advantageous form of constant current generator may be constructed using a bipolar transistor with its emitter and collector terminals directly connected to column line 844 and supply voltage $V_{drive}$ 842. This bipolar transistor may be incorporated into a current mirror, the output current being programmed or controlled by, for example, resistors switched using MOSFETs. Similar techniques are described in the applicant's co-pending UK patent application no. 0206062.2.

The voltage for $V_{drive}$ may be provided, for example, by a separate output from power supply unit 822.

The embodiment of the display driver illustrated in FIG. 8 shows a current-controlled active matrix display in which a column electrode current to set a pixel brightness. It will be appreciated that a voltage-controlled active matrix display, in which the brightness of a pixel is set by the voltage on a column line, could also be employed by using voltage rather than current drivers for column data drivers 834.

The control input 832 of row select drivers 830 and the data input 836 of column data drivers 834 are both driven by display drive logic circuitry 846 which may, in some embodiments, comprise a microprocessor. The display drive logic 846 is clocked by a clock 848 and, in the illustrated embodiment, has access to a frame store 850. Pixel brightness and/or colour data for display on display 802 is written to display drive logic 846 and/or frame store 850 by means of data bus 852.

The display drive logic has a sense input 856 driven from the output of an analogue-to-digital converter 854. Analogue-to-digital converter 854 is used to monitor the voltage on each of column electrodes 808*a-e* that is, for example, the voltage on line 844. To monitor these voltages a plurality of analogue-to-digital converters may be employed or one or more A/D converters may be time multiplexed to monitor the column electrode voltages. The voltages on the column electrodes correspond to the gate voltages of the pixel driver transistors in a selected row, as will be explained below for the specific examples of the previously described pixel driver circuits. Although not explicitly shown in FIG. 8 it is desirable, but not essential, also to measure the supply voltage $V_{drive}$ 842, for example for compliance determination. This may be done by using analogue-to-digital converter 854, either by using a separate input on the converter or by time multiplexing the converter, or a separate analogue-to-digital converter may be employed to provide a $V_{drive}$ sense signal to display drive logic 846.

In FIG. 2*a* when a row is selected transistors 220 and 222 are turned on and thus the column data line 210 is effectively connected to the gate of driver transistor 212. In FIG. 3*a* when row select line 306 is active transistors 320 and 322 are turned on and the gate of driver transistor 310 is effectively connected to column data line 308 and thus the voltage on column data line corresponds to the gate voltage of driver transistor 310. In a similar way in FIG. 3*b* transistor 350 connects column line 308 to driver transistor control line 315, and in FIG. 3*c* transistor 360 connects column line 308 to driver transistor control line 315. In FIG. 4 column data line 408 is connected to the gate of driver transistor 410 when transistors 420 and 422 are on. It can therefore be appreciated that although the aforementioned circuits employ a current to set the pixel brightness, the current in effect determines a gate voltage drive level to provide the required brightness and this gate voltage drive level appears on the relevant column data line. In the context of FIG. 8 it can be seen that this gate drive voltage will appear on the current output line 844 of constant current generator 40. It will be appreciated that this is the case whether, as in circuit FIG. 2*a,* the constant current generator sets the current in the driver transistor directly or whether, as for example in FIG. 3*a,* the constant current generator sets a current in a photodiode, the driver transistor being driven such that the OLED brightness is that required by the photodiode current set by the constant current generator.

In the arrangement of FIG. 2*b* when row conductor 262 is active transistor 260 is on and column conductor 264 is connected to the gate of the driver transistor 256. Thus, again, the voltage on the column conductor 264 corresponds to that on the gate of the driver transistor 256, although in the case of FIG. 2*b.* It is the voltage on conductor 264 which determines the brightness of OLED 254, as described above.

Referring again to FIG. 8, the display drive logic 846 includes a gate voltage sense unit 858 and a power controller 860. One or both of the sense unit and power controller may be implemented as processor control code where the display drive logic 846 includes a processor. The gate voltage sense unit 858 reads a voltage on sense input 856 and the power controller 860 outputs a voltage control signal to input 826 of power supply unit 822 to control power supply voltage $V_{ss}$ in response to the sensed input voltage. The operation of the power controller is described in more detail below with reference to FIGS. 9*a* and 9*b* for current- and voltage-controlled active matrix displays respectively.

FIG. 9*a* shows a flow diagram of a procedure which may be implemented by power controller 860 in embodiments of a display driver for driving a current-controlled active matrix display. Broadly speaking the power controller 860, in conjunction with the gate voltage sense unit 858 and analogue-to-digital converter 854 scans all the pixels of display 802 to identify the brightest illuminated pixel, that is the pixel with the maximum drive transistor gate voltage, and then controls the power supply to reduce $V_{ss}$ until the maximum gate voltage is substantially equal to the maximum voltage available given the level of $V_{drive}$ 842 and the compliance of constant current generator 840.

Referring to the flow chart, step S900 the power controller 860 uses the gate voltage sensor 858 to read the gate voltage $V_g$ for all the pixels by reading the voltage on column electrodes 808*a-e* as each row of the display in turn is selected. The power controller ten, at step S902, identifies the maximum $V_g$ value of those read which, in effect, identifies the drive for the brightest pixel or pixels. In alternative embodiments the brightest pixel or pixels may be determined in some other way, for example by interrogating the data in frame store 850 or by tracking the data written to the display using bus 852.

At step S904 the power controller determines whether or not the maximum $V_g$ is less than the maximum available $V_g$, that is in the circuit of FIG. 8 for example the maximum voltage which could be provided on a column drive line such as line 844. If $V_g$ is not less than the maximum available there is no scope to educe the power supply voltage without reducing the brightness of the brightest illuminated pixel. More specifically, however, if $V_g$ is not less than the maximum available drive voltage the power supply voltage $V_{ss}$ is insufficient and is therefore increased, at step S910. The procedure then loops back to step S900 to rescan the display so that changes in pixel brightness may be detected. If desired the $V_g$ thresholds for increasing and reducing $V_{ss}$ may be different to provide a degree of hysteresis in the control of $V_{ss}$, for example making the threshold for reducing $V_{ss}$ higher than that for increasing $V_{ss}$.

If, at step S904, it is determined that the drive voltage to the display is less than the maximum available drive voltage the power controller, at step S908, outputs a control signal to switch mode power supply unit 822 to reduce the power supply $V_{ss}$ on line 828 to display 802. The procedure then again loops back to step S900 to re-check which pixel is most strongly driven and to recheck whether there is any further scope for reducing $V_{ss}$. The reduction in $V_{ss}$ at step S908 may be small so that $V_{ss}$ changes only gradually, which may be appropriate where the brightest pixel is, on average, not at maximum illumination or where the display is occasionally briefly black (that is non-illuminated). Alternatively the reduction in $V_{ss}$ may be large where, for example, a rapid response is preferred.

As $V_{ss}$ is reduced the constant current drive, that is the constant current generator 840 in the arrangement of FIG. 8, automatically increases the drive voltage to the display in order to attempt to drive the current required by the desired pixel brightness on to the relevant display control line. To read the drive voltage from the pixel or pixels with the maximum $V_g$ the appropriate row of the display may be selected using row select drivers 830 and the voltage read using analogue-to-digital converter 854 whilst driving at least the monitored pixel (and, if necessary, all the pixels of the row to prevent loss of data) with its specified current drive using column data drivers 834.

FIG. 9*b* shows a flow chart for a similar procedure in which the active matrix display 802 is voltage driven, for example using pixel driver circuits similar to those shown in FIG. 2*b*. In FIG. 9*b*, as with FIG. 9*a*, the procedure initially, at step S920, reads the voltage drive for the pixels of the display and identifies the pixel with the maxim voltage drive. As described above, in the circuit of FIG. 2*b* the gate voltage of transistor 256 gradually decays according to the brightness of OLED 254. Thus, at step S922, the drive voltage of the pixel with the maximum gate voltage drive is monitored at the end of the relevant decay cycle, typically the end of a fame period. This function may be performed actively, for example by controlling row select drivers 830, but preferably is performed during the usual frame scanning process required by the circuit of FIG. 2*b*, for example by implementing a read-before-write data access cycle. Broadly speaking the procedure then checks to see whether the gate voltage has decayed sufficiently to switch off the OLED associated with the brightest) pixel, that is in the context of FIG. 2*b*, to check whether photodiode 266 has substantially fully discharged gate capacitor 258. If the voltage has decayed sufficiently, that is if the gate capacitor is sufficiently discharged, the associated pixel OLED is sufficiently bright and the power supply voltage may be reduced, otherwise the power supply voltage may be increased. Thus $V_{ss}$ is on/off servo controlled around the point of maximum efficiency operation for the display plus driver combination.

In more detail, at step S924 the drive voltage of the pixel with the greatest drive voltage is compared with a threshold voltage. This threshold voltage may be 0V, for example to check whether the gate capacitor has completely discharged, but is preferably a threshold gate voltage of the driver transistor as once the drive voltage falls below this threshold voltage the driver transistor will be switched off and the associated OLED non-illuminated. If the drive voltage is less than the threshold voltage the power supply voltage $V_{ss}$ is more than required by the maximum brightness pixel and thus, at step S926, $V_{ss}$ is reduced and the procedure loops back to step 920. If the voltage has not decayed to the threshold voltage $V_{ss}$ is insufficient for the maximum required pixel. brightness and thus, at step S928, $V_{ss}$ is increased and again the procedure looks back to step S920 to re-check all the pixels. If desired a degree of hysteresis may be incorporated into the $V_{ss}$ control by making the threshold drive voltages for reducing and increasing $V_{ss}$ different. More particularly the threshold or reducing $V_{ss}$ may be lower (smaller in absolute terms) than the threshold for increasing $V_{ss}$.

In the procedures of FIG. 9*a* and/or FIG. 9*b* some or all of steps S908, S910, S926 and S928, in which the power supply voltage $V_{ss}$ to the display is altered, may include an additional step of rewriting data to the display, in particular rewriting data setting the brightness of illuminated pixels of the display. The skilled person will recognise that changing the power supply to the display will have the effect of changing the brightness of the pixels to which data has already been written. This does not represent a significant problem in a voltage-controlled display employing pixels such as shown in FIG. 2*b* since such a display, in any case, is refreshed at regular intervals to compensate for the decay in the stored pixel voltages. However in a current-controlled display refresh of the display may only be carried out at longer intervals or, in some instances, not at all.

A small change in the overall brightness of the display may not be thought to represent a significant problem and whether or not elements of the display are refreshed may be determined based upon, for example, the magnitude of the changes to $V_{ss}$ and the rapidity with which the displayed data is in any case changing. For example where the data is changing rapidly rewriting the displayed data may not be considered necessary. Alternatively the entire display may be scanned and rewritten at intervals although these intervals, need not correspond to the frame intervals conventionally associated with raster scanned or passive matrix displays as the purpose of the refresh is not to prevent flicker but merely to compensate for small brightness changes.

The procedures described with reference to FIGS. 9*a* and 9*b* lend themselves to digital implementation but the control functions may also be implemented in analogue circuitry or in a mixture of digital and analogue circuitry. In particular, FIG. 10 shows a circuit diagram of a maximum voltage detector which may be employed to determine the maximum value of $V_g$ in step S902 of FIG. 9*a* or in step S920 of FIG. 9*b*.

In FIG. 10 each column electrode 808*a-e* is connected to a reactive diode 1002*a-e* to sample the voltage on each column line. The diode OR arrangement outputs on line 1004 the maximum voltage on any one of the column electrode lines less a diode voltage drop. A peak detect circuit 1005 comprises a capacitor 1006 to store the voltage on line 1004 and a controllable switch 1008 which is closed in response to a signal on reset line 1010 to reset the charge on capacitor 1006. The maximum detected voltage output on line 1004 may be buffered with a high input impedance amplifier. The reset line 1010 maybe controlled by display drive logic 846 of FIG. 8 and the maximum column voltage output on line 1004 may be provided to an analogue digital converter, such as ADC 854 of FIG. 8, for digitisation prior to inputting to display drive logic 846. In this way the sensing circuitry and ADC 854 may be simplified.

Circuits and methods have been described with reference to their use for driving organic LEDs but the circuits and methods may also be employed with other types of active matrix electroluminescent display such as inorganic TFE (Thin Film Electroluminescent) displays, gallium arsenide on silicon displays, porous silicon displays, and the like. The circuits and methods are not restricted to use with displays with pixel driver circuits of the types shown but may be employed with any display in which a current controls a display characteristic. Similarly applications of the invasion are not limited to displays comprising a grid of pixels but may also be used with, for example, segmented displays.

No doubt many other effective alternatives will occur to the skilled person and it should be understood that the invention is not limited to the described embodiments.

The invention claimed is:

1. A display driver for an active matrix electroluminescent display, the display comprising a plurality of electroluminescent pixels each pixel comprising a pixel driver circuit and a display element, each said pixel driver circuit including a drive field effect transistor having a gate connection for driving the associated display element in accordance with a voltage on the gate connection to produce a driving current through said display element, the display driver comprising:

a display element brightness controller configured to provide an output to drive a said gate connection to control the electroluminescent output from a said pixel;

a voltage sensor to sense a said voltage on said gate connection; and a power controller coupled to said voltage sensor for controlling an adjustable voltage power supply to each of said plurality of electroluminescent pixels, said power controller configured to read a sensed voltage on each said pixel gate connection within a predetermined period to identify a display element having a maximum brightness relative to others of said display elements within said predetermined period, wherein said display element brightness controller and said power controller are configured to, respectively and concurrently within a period, increase said voltage on said gate connection of said pixel having said identified display element and to reduce said power supply voltage, to a point where the voltage of said adjustable voltage power supply is just sufficient to maintain a current to said identified display element substantially equal to a predetermined current corresponding to a current that is produced in said identified display element prior to said increasing of said voltage on said gate connection and said reducing of said power supply voltage, said increasing and said reducing in response to a said sensed voltage on said gate connection of said pixel having said identified display element, wherein said increasing and said reducing are performed as long as said sensed voltage on said gate connection is determined to be less than a maximum available voltage for outputting from said brightness controller to said display element and until said voltage on said gate connection substantially reaches said maximum available voltage.

2. A display driver as claimed in claim 1 wherein said voltage sensor is configured to sense the voltage on a said gate connection by sensing the voltage on an electrode of said display.

3. A display driver as claimed in claim 1 wherein a said pixel includes a photodiode, and wherein a photocurrent through said photodiode is determined by a said adjustable constant current to determine a brightness of said pixel.

4. A display driver as claimed in claim 1 wherein said power controller is further configured to increase said power supply voltage when said gate connection voltage of said brightest pixel has not reduced to less than a threshold value after a predetermined interval.

5. A display driver as claimed in claim 1 further comprising said adjustable voltage power supply.

6. A method of operating an active matrix electroluminescent display, the display comprising a plurality of electroluminescent pixels each pixel comprising an associated pixel driver and a display element, each said pixel driver including a drive field effect transistor having a gate connection for driving the associated display element in accordance with a voltage on the gate connection to produce a driving current through said display element, the display having an adjustable voltage power supply coupled to provide a power supply voltage to each of said plurality of electroluminescent pixels, and a plurality of control lines corresponding to said gate connections for setting the brightness of each pixel, the method comprising:

setting the brightness of pixels of the display using said control lines to drive said gate connections;

monitoring said control lines of the display to sense said voltages on said gate connections, and controlling said adjustable voltage power supply to each of said plurality of electroluminescent pixels by reading a sensed voltage on each said gate connection within a predetermined period to identify a display element having a maximum brightness relative to others of said display elements within said predetermined period; and concurrently within a period, reducing said power supply voltage and increasing said voltage on said gate connection of said pixel having said identified display element, responsive to said monitoring to a point where a voltage of said adjustable voltage power supply is just sufficient to maintain a current to said identified display element substantially equal to a predetermined current corresponding to a current that is produced in said identified display element prior to said increasing of said voltage on said gate connection and said reducing of said power supply voltage, said increasing and said reducing in response to a said sensed voltage on said gate connection of said pixel having said identified display element, wherein said increasing and said reducing are performed as long as said sensed voltage on said gate connection is determined to be less than a maximum available voltage for outputting to said display element and until said voltage on said gate connection substantially reaches said maximum available voltage.

7. A method as claimed in claim 6 wherein a said pixel includes a photodiode and wherein a current through said photodiode is determined by an adjustable constant current.

8. An active matrix display driver configured to operate in accordance with the method of claim 6.

9. A display driver as claimed in claim 1 wherein said electroluminescent display comprises an organic light emitting diode display.

10. A method as claimed in claim 6 wherein said electroluminescent display comprises an organic light emitting diode display.

* * * * *

UNITED STATES PATENT AND TRADEMARK OFFICE

CERTIFICATE OF CORRECTION

PATENT NO. : 7,834,824 B2
APPLICATION NO. : 10/518182
DATED : November 16, 2010
INVENTOR(S) : Paul R. Routley et al.

It is certified that error appears in the above-identified patent and that said Letters Patent is hereby corrected as shown below:

At Column 2, line 10, “activate&” should be -- activated --.

At Column 2, line 25, “it” should be -- it. --.

At Column 5, line 19, “photocurrent” should be -- photocurrent. --.

Signed and Sealed this
Thirty-first Day of May, 2011

David J. Kappos

David J. Kappos
*Director of the United States Patent and Trademark Office*